United States Patent [19]

Baltz et al.

[11] 4,284,040

[45] Aug. 18, 1981

[54] FUEL PRIMER FOR AN INTERNAL COMBUSTION ENGINE

[75] Inventors: Gene F. Baltz, Lake Villa; Chester G. DuBois, Zion, both of Ill.

[73] Assignee: Outboard Marine Corporation, Waukegan, Ill.

[21] Appl. No.: 60,288

[22] Filed: Jul. 25, 1979

[51] Int. Cl.[3] ..... F02M 1/16

[52] U.S. Cl. ..... 123/187.5 R; 123/73 A; 123/180 E

[58] Field of Search ..... 123/187.5 R, 179 L, 123/179 G, 180 R, 180 E, 73 R, 73 A, 73 C, 75 RC, 75 CC

[56] References Cited

U.S. PATENT DOCUMENTS

| | | | |
|---|---|---|---|
| 1,653,853 | 12/1927 | Hill | 123/187.5 R |
| 1,730,115 | 10/1929 | Bristol | 123/180 E |
| 2,287,900 | 6/1942 | Parker | 123/187.5 R |
| 2,601,562 | 6/1952 | Schoeppner et al. | 123/187.5 R |
| 3,614,945 | 10/1971 | Schlagmuller et al. | 123/187.5 R |
| 3,881,454 | 5/1975 | Jaulmes | 123/73 R |
| 3,978,839 | 9/1976 | DuBois et al. | 123/187.5 R |

FOREIGN PATENT DOCUMENTS

| | | | |
|---|---|---|---|
| 454376 | 2/1949 | Canada | 123/187.5 R |
| 144488 | 6/1920 | United Kingdom | 123/187.5 R |

*Primary Examiner*—Charles J. Myhre
*Assistant Examiner*—Andrew M. Dolinar
*Attorney, Agent, or Firm*—Michael, Best & Friedrich

[57] ABSTRACT

An engine comprises a combustion chamber and interior walls which define a fuel induction passage having a fuel outlet port communicating with the combustion chamber. A first fuel delivery system introduces fuel from a fuel source into the combustion chamber. A second fuel delivery system includes a nozzle which extends into the fuel induction passage adjacent to the fuel outlet port and is selectively operable by means of an associated valve mechanism for introducing fuel from the source directly into the combustion chamber through the nozzle in addition to the fuel which is introduced into the combustion chamber by the first fuel delivery system.

6 Claims, 2 Drawing Figures

FUEL PRIMER FOR AN INTERNAL COMBUSTION ENGINE

FIELD OF THE INVENTION

The invention generally relates to internal combustion engines and, more particularly, to fuel priming systems for internal combustion engines.

DESCRIPTION OF THE PRIOR ART

Fuel priming systems for internal combustion engines are known and disclosed in the following United States Patents:

Parker, U.S. Pat. No. 2,287,900, June 30, 1942
Casteel, U.S. Pat. No. 2,553,079, May 15, 1951
Roosa, U.S. Pat. No. 2,821,183, Jan. 28, 1958
Gastinne, U.S. Pat. No. 3,548,796, Dec. 22, 1970
Schlagmuller et al, U.S. Pat. No. 3,614,945, Oct. 26, 1971
Rachel, U.S. Pat. No. 3,646,915, Mar. 7, 1972
Nagy et al, U.S. Pat. No. 3,646,918, Mar. 7, 1972
Aono, U.S. Pat. No. 3,704,702, Dec. 5, 1972
Porsche et al, U.S. Pat. No. 3,799,138, Mar. 26, 1974
Mondt, U.S. Pat. No. 3,888,223, June 10, 1975

SUMMARY OF THE INVENTION

The invention provides an engine comprising a combustion chamber and wall means for defining a fuel induction passage having a fuel outlet port communicating with the combustion chamber. First fuel delivery means communicates with the combustion chamber and is adapted for connection to a fuel source, the first fuel delivery means being operative for introducing fuel from the fuel source into the combustion chamber. In addition, second fuel delivery means is adapted for connection to a fuel source and includes nozzle means which extends into the fuel induction passage adjacent to the fuel outlet port for emitting fuel directly into the combustion chamber through the fuel outlet port. The second fuel delivery means is thereby operative for introducing fuel from the source directly into the combustion chamber through the nozzle means in addition to the fuel which is introduced by the first fuel delivery means. Control means is connected to the second fuel delivery means for selectively operating the second fuel delivery means to introduce fuel directly into the combustion chamber through the nozzle means.

In accordance with one embodiment of the invention, the first fuel delivery means includes first fuel conduit means for conducting fuel from the fuel source to the combustion chamber, and first fuel pumping means which communicates with the first fuel conduit means for pumping fuel through the first fuel conduit means from the fuel source into the combustion chamber. In this embodiment, the second fuel delivery means includes second fuel conduit means which communicates with the first fuel pumping means and the nozzle means and which conducts fuel from the first fuel pumping means into the combustion chamber through the nozzle means subject to the operation of the control means.

In accordance with one embodiment of the invention, the control means includes valve means which communicates with the second fuel conduit means and which is operatively movable between a closed position for interrupting the conduction of fuel from the first fuel pumping means into the combustion chamber through the nozzle means and an open position for permitting the conduction of fuel from the first fuel pumping means into the combustion chamber through the nozzle means.

In accordance with one embodiment of the invention, the valve means is biased toward the closed position, and activating means is provided for moving the valve means against the action of the biasing means from the closed position to the open position.

In accordance with one embodiment of the invention, the activating means includes an electrically actuated solenoid as well as manual means for moving the first valve means from the closed position to the open position against the action of the biasing means.

One of the principal features of the invention is the provision of an engine having second fuel delivery means which is selectively operable for emitting fuel directly into the combustion chamber through a nozzle to enrich the quantity of combustible fuel which is delivered to the engine.

Other features and advantages of the embodiments of the invention will become apparent upon reviewing the following general description, the drawings, and the appended claims.

Figure 1:
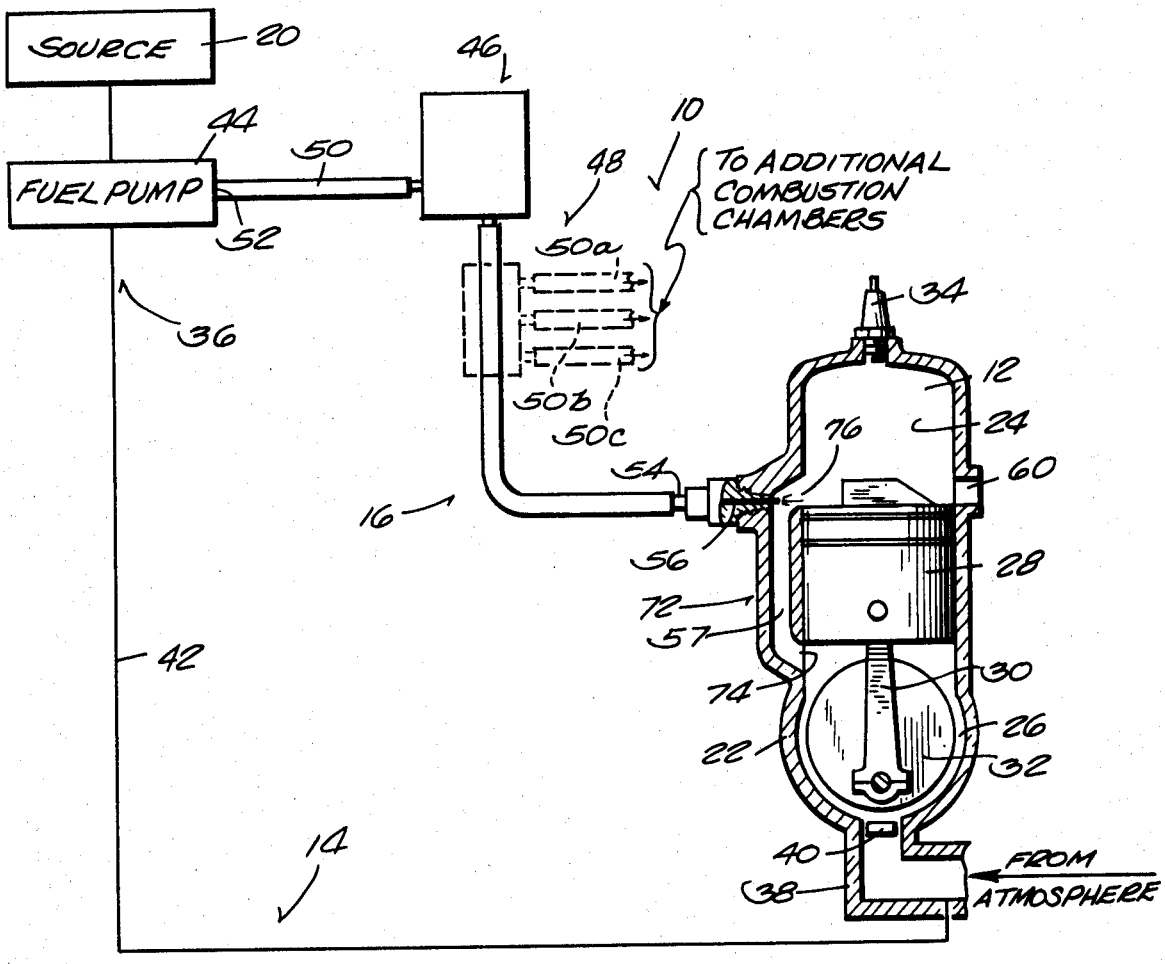
FIG. 1 is a diagrammatic view of an internal combustion chamber which embodies various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is an internal combustion engine 10 which embodies various of the features of the invention. Generally, the engine 10 includes a combustion chamber 12 and associated first and second fuel delivery means, respectively 14 and 16 which introduce fuel into the combustion chamber 12 to sustain engine operation.

While various engine constructions are possible, in the illustrated embodiment, a block member 22 includes a cylinder 24 which defines the combustion chamber 12. The block member 22 also includes a crankcase 26 which extends from the cylinder 24. A piston 28 is mounted for reciprocative movement inside the cylinder 24, being connected by a connecting rod 30 to a crankshaft 32 which is rotatably mounted in the crankcase 26. A spark plug 34 or the like extends into the combustion chamber 12, and fuel which is introduced into the combustion chamber 12 by the first and second fuel delivery means 14 and 16 is ignited by the spark plug 34, thereby causing reciprocative movement of the piston 28 which in turn drives the crankshaft 32.

The block member 22 also includes wall means 72 which defines a fuel induction passage 57 having a fuel intake port 74 communicating with the crankcase 26 and a fuel outlet port 76 communicating with the combustion chamber 12.

The first fuel delivery means 14 includes first fuel conduit means 36 which is suitably connected to a source of fuel 20 and conducts fuel from the fuel source 20 to the combustion chamber 12. While various constructions are possible, in the illustrated embodiment, the first fuel conduit means 36 includes an air induction passage 38 which directs air from the atmosphere into the crankcase 26, typically through a conventional reed valve assembly 40. A conduit 42 delivers fuel from the fuel source 20 into the air induction passage 38, and first fuel pumping means 44, such as an electrical fuel pump or the like, is provided for pumping fuel through the conduit 42.

By virtue of this construction, an air-fuel mixture is formed in the air induction passage 38, being thereafter drawn through the reed valve assembly 40 and the fuel induction passage 57 into the combustion chamber 12 in response to pulsating pressure variations which occur in the crankcase 26 and which are occasioned by piston reciprocation. As should now be apparent, the first fuel delivery means 14 represents the primary fuel supply system for the engine 10.

When the engine 10 is cold or has been inoperative for some time, it is often desirable to crank the engine 10, such as by a manually or electrically acutated starter mechanism (not shown), for an extended period of time in order that a sufficient combustible quantity of fuel is delivered by the first fuel delivery means 14 to the combustion chamber 12. To supplement the supply of combustible fuel which is introduced into the combustion chamber 12 during cranking operations, and to thereby facilitate starting of the engine 10, the second fuel delivery means 16 introduces fuel into the combustion chamber 12 in addition to the fuel which is introduced by the first fuel delivery means 14. Associated control means 46 is connected with the second fuel delivery means 16 so that the second fuel delivery means 16 can be selectively operated. As thus described, the second fuel delivery means 16 represents a fuel priming system for the engine 10.

While various constructions are possible, in the illustrated embodiment, the second fuel delivery means 16 includes second fuel conduit means 48 which communicates with the fuel pump 44 and the combustion chamber 12 and which conducts fuel from the fuel pump 44 into the combustion chamber 12, subject to the operation of the control means 46.

More particularly, a first conduit 50 has an inlet end 52 which is connected with the fuel pump 44 and has an outlet end 54 which is connected to a fuel metering orifice or nozzle 56. The nozzle 56 extends into the fuel induction passage 57 adjacent to the fuel outlet port 76 such that fuel emitted by the nozzle 56 enters the combustion chamber 12 through the outlet port 76 in addition to the fuel which is introduced by the first fuel delivery means 14 and which is drawn by pulsating pressure through the fuel induction passage 57 via the fuel intake port 74.

By virtue of this construction, fuel delivered by the second fuel delivery means 16 is emitted directly into the combustion chamber 12 through the outlet port 76, and the requirement for a conventional choke valve assembly (not shown) in the air induction passage 38 is thereby eliminated. Likewise, the possibility of "overchoking" or flooding the engine 10 during priming is substantially reduced, inasmuch as any excess fuel emitted into the combustion chamber 12 by the nozzle 56 will be quickly expelled from the combustion chamber 12 through the exhaust port 60 by pulsating pressure occasioned by piston reciprocation during cranking.

Figure 2:
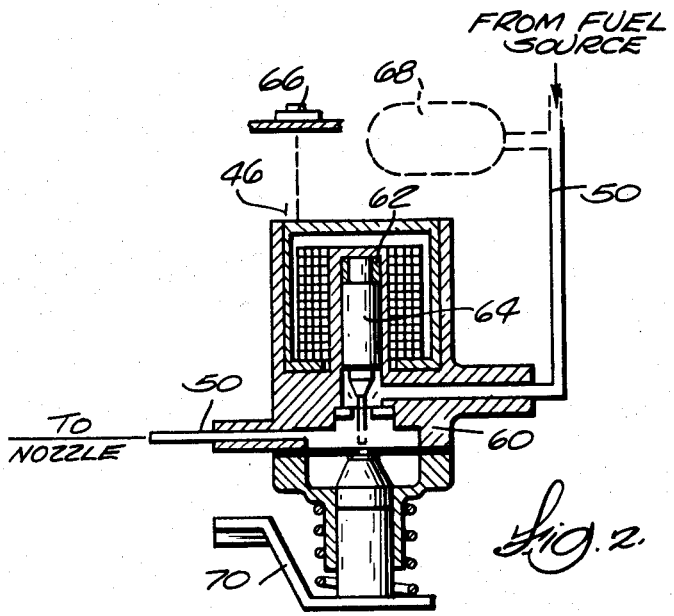
FIG. 2 is a broken away side view of the control valve which is incorporated in the engine shown in FIG. 1.

Referring now to FIG. 2, the control means 46, which controls the conduction of fuel through the second fuel delivery means 16, includes a valve assembly 60 which is connected in line with the first conduit 50 between the fuel pump 44 and the nozzle 56. The valve 60 is operatively movable between a closed position (shown in phantom lines in FIG. 2) for interrupting the flow of fuel to the nozzle 56 through the first conduit 50 and an open position (shown in solid lines in FIG. 2) for permitting the flow of fuel to the nozzle 56 through the first conduit 50.

In order that the valve 60 may be selectively moved between the closed and open positions, in the illustrated embodiment (see FIG. 2), the valve 60 is biased toward the closed position, such as by a spring 62, and an electrically controlled solenoid 64 is operatively connected with the valve 60 for moving the valve 60 from the closed position to the open position against the action of the biasing spring 62. The solenoid 64 is in turn operated by means of a conventional switch 66 which is accessible for operation by the engine operator. Thus, as the operator actuates the engine starter mechanism (not shown), the operator may simultaneously actuate the switch 66 to operate the second fuel delivery means 16 to prime the engine 10.

As heretofore described, the fuel pump 44 and the valve 60 are electrically actuated, typically by means of a battery (not shown). In order that the engine may be manually primed should electrical failure occur, a manually actuated fuel pump, such as a resilient "squeeze" bulb 68 or the like (shown in phantom lines in FIG. 2), may be connected with the first conduit 50, and a manually actuated lever assembly 70 may be operatively connected with the valve 60 so that the valve 60 may be manually opened against the action of the biasing spring 62. The squeeze bulb 68 and lever assembly 70 provide a secondary or back-up primer system should electrical failure occur.

The second fuel delivery means 16 as heretofore described is applicable for use with engines having more than one combustion chamber. More particularly, and as shown diagrammatically in phantom lines in FIG. 1, additional conduits 50*a*, 50*b*, 50*c*, etc. may communicate with the conduit 50 downstream of the control valve 60. While not shown in FIG. 1, it is to be appreciated that each additional conduit 50*a*, 50*b*, 50*c*, etc. communicates with an associated combustion chamber in identical fashion as conduit 50 communicates with the combustion chamber 12 through the nozzle 56. Thus, operation of the control valve 60 serves to emit fuel directly and simultaneously into all combustion chambers.

Various of the features of the invention are set forth in the following claims.

We claim:

1. An engine comprising a combustion chamber, wall means for defining a fuel induction passage having a fuel outlet port communicating with said combustion chamber, fuel pumping means adapted for connection to a fuel source, first fuel delivery means communicating with said fuel pumping means for delivery of fuel thereto and with said fuel induction passage for introducing fuel therefrom into said combustion chamber, second fuel delivery means communicating with said fuel pumping means for delivery of fuel thereinto independently of said first fuel delivery means and including nozzle means extending into said fuel induction passage adjacent to said fuel outlet port for emitting fuel directly into said combustion chamber through said fuel outlet port, said second fuel delivery means being operative for introducing fuel directly into said combustion chamber through said nozzle means in addition to the fuel introduced by said first fuel delivery means, and control means connected to said second fuel delivery means for selectively operating said second fuel delivery means to introduce fuel into said combustion chamber through said nozzle.

2. An engine according to claim 1 wherein said control means includes valve means incorporated in said second fuel delivery means and operatively movable between a closed position for interrupting the conduction of fuel from said fuel pumping means to said combustion chamber through said nozzle means and an open position for permitting the conduction of fuel from said fuel pumping means to said combustion chamber through said nozzle means, and means for selectively moving said valve means between said closed position and said open position.

3. An engine according to claim 2 wherein said means for selectively moving said valve means includes means for biasing said valve means toward said closed position, and activating means for moving said valve means against the action of said biasing means from said closed position to said open position.

4. An engine according to claim 3 wherein said activating means includes an electrically actuated solenoid.

5. An engine according to claim 3 or 4 wherein said activating means includes means for manually moving said first valve means from said closed position to said open position.

6. An engine according to claim 1 and further including a piston mounted for reciprocative movement within said combustion chamber and a crankcase extending from said combustion chamber, said crankcase forming a source of pulsating pressure in response to piston reciprocation, wherein said fuel induction passage includes an intake port spaced from said fuel outlet port and communicating with said crankcase, and wherein said first fuel delivery means includes a carburetor communicating with said crankcase for emitting fuel into said crankcase for delivery through said fuel induction passage from said crankcase into said combustion chamber in response to pulsating pressure variations occasioned by piston reciprocation.

* * * * *